US005478071A

United States Patent [19]

Barrs et al.

[11] Patent Number: 5,478,071

[45] Date of Patent: Dec. 26, 1995

[54] VISUAL ASSISTED GOLF PRACTICE PUTTING AID

[76] Inventors: Carl A. Barrs, 209 Sylvia Dr., Yorktown, Va. 23693; Tony P. DeLuca, 21175 Wildflower Sq., Ashburn, Va. 22011

[21] Appl. No.: 385,928

[22] Filed: Feb. 9, 1995

[51] Int. Cl.[6] ..... A63B 69/36

[52] U.S. Cl. ..... 273/35 R; 273/34 R; 273/178 R; 273/181 R

[58] Field of Search ..... 273/35 R, 35 A, 273/181 R, 32 R, 32 H, 34 R, 34 A, 34 B, 177 R, 178 R, 178 B

[56] References Cited

U.S. PATENT DOCUMENTS

| | | | |
|---|---|---|---|
| 2,677,547 | 5/1954 | Campbell | 273/181 R |
| 3,195,897 | 7/1965 | Labrique | 273/177 R |
| 4,906,006 | 3/1990 | Sigunick | 273/178 R |
| 4,928,417 | 5/1990 | Boudreau | 273/34 R X |
| 5,078,394 | 1/1992 | Kretz | 273/178 R X |
| 5,205,559 | 4/1993 | Plopper | 273/177 R |
| 5,249,384 | 10/1993 | Dark, Jr. | 273/34 X |
| 5,257,808 | 11/1993 | Mueller et al. | 273/178 R |
| 5,275,404 | 1/1994 | Dimaano et al. | 273/178 R |
| 5,415,397 | 5/1995 | Van Holt, Jr. | 273/348 |

*Primary Examiner*—William H. Grieb
*Attorney, Agent, or Firm*—Nixon & Vanderhye

[57] ABSTRACT

The practice aid includes an annulus for resting on the margin of and about a golf hole. The annulus includes a central opening and one or more downward projections for disposition within the golf hole to prevent lateral displacement of the annulus from the hole. Visual indicia identifying one or more target locations are provided on the upper planar surface of the annulus at spaced locations thereabout. The visual indicia may comprise differently colored segments to facilitate alignment of the putt and enable the golfer to putt the golf ball through tile central opening of the annulus into the golf hole. The practice aid enables the golfer during actual golf play to visualize a target area about the hole and thus focus and concentrate on putting the ball to that target location.

20 Claims, 4 Drawing Sheets

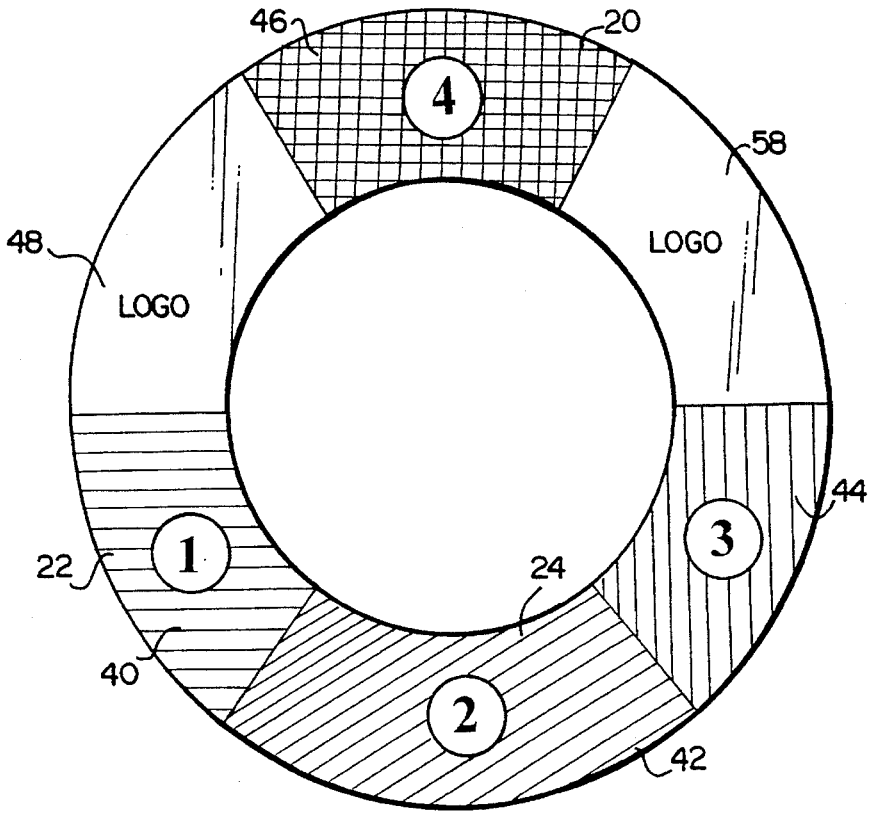
Fig. 3
Fig. 4
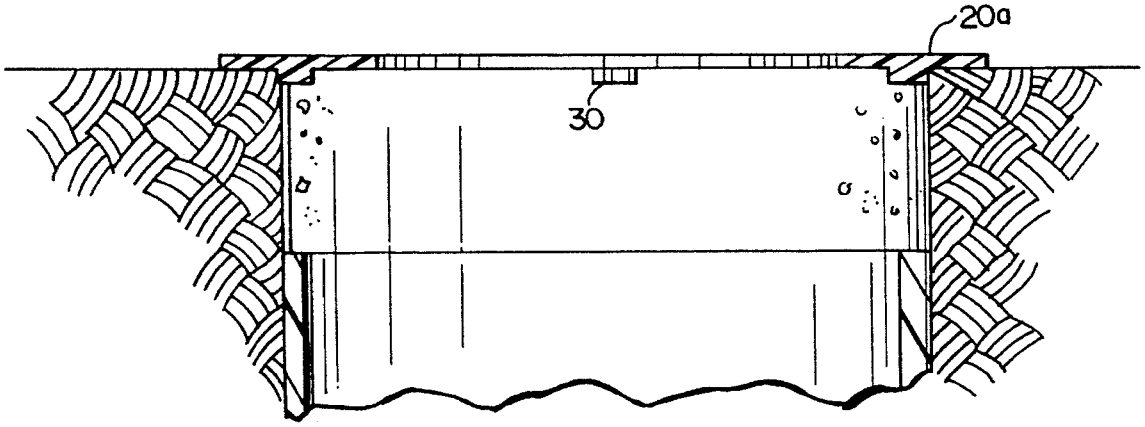

VISUAL ASSISTED GOLF PRACTICE PUTTING AID

TECHNICAL FIELD

The present invention relates to an aid for putting a golf ball and particularly relates to a putting ring affording visual assistance to the golfer during putting practice, enabling the golfer to more completely focus on a putt during actual golf play.

BACKGROUND

With the number of golfers in the United States and other countries steadily increasing, specific attention has been recently directed to the most difficult part of the game of golf, i.e., putting, and many and various types of practice putting devices have been developed, marketed and used. For example, golf ball targets simulative of the dimensions of a golf hole have been developed. Such targets are typically for indoor usage. One such device includes essentially a flat disk with a number of pivoted elements surrounding the disk about its margins, the interior edges of the elements roughly defining an area corresponding to the lateral dimensions of a golf hole. A typical golfer may use this device to practice putts indoors, for example, putting on a horizontal surface, such as a rug, and rolling the golf ball up to and over the pivoted elements into the "cup." Another device marketed as a golf putting practice device comprises a flat, flexible disk having three upstanding projections defining a triangular area for receiving a golf ball. One of the upstanding projections serves as a target for the golfer. Again, such device is intended primarily for indoor use where the non-professional or professional golfer may practice putting by rolling the ball along a horizontal surface such that the golf ball rolls onto the disk and into the triangular area defined by the upstanding projections. While practice devices of this type are satisfactory for their limited intended purpose, they do not and cannot simulate actual golfing conditions such as reading the green to ascertain any prospective break or breaks of the ball and aligning and stroking the ball to accommodate for the contour of the green.

Even for those golfers who consistently use practice putting greens, most golfers have great difficulty in aligning the putt because, among other things, of a lack of definition of the golf hole or cup. The average golfer, and even those advanced and professional golfers, have great difficulty in focussing on the putt at hand and excluding from their mental processes thoughts extraneous to rolling the golf ball into the hole. Sports psychologists have recognized, particularly in the game of golf, that a correct mental attitude during this difficult portion of the game of golf is necessary for consistent and accurate putting. It has been found that by focussing positively and with only one thought in mind, i.e., making the putt, the golfer's game can be significantly improved. To applicants' knowledge, there has not previously been a golf putting practice aid which facilitates this mental concentration and which eliminates or minimizes negative or other thoughts which an individual golfer may have when attempting to putt during actual golf play.

One of the principal aspects of putting is, of course, the alignment of the putt with the hole or cup. As indicated previously, the cup lacks definition. Advanced and professional golfers, however, recognize that to successfully putt and to align the putt to run along the various contours of the putting surface between the ball location and the cup requires the golfer to focus on certain parts of the hole or outside of the hole rather than on the hole per se. For example, the hole is often mentally divided by those advanced and professional golfers into target areas or locations along each side of the hole. These target locations may be defined, for example, on the left side of the hole as the outside left edge, the left edge, inside left edge and left center edge. These target areas or locations, of course, are similar on the right side of the hole. Additionally, the center and back side of the hole are likewise target areas to which a golfer may wish to aim the putt. Without significant hole definition, it is oftentimes difficult to mentally focus on a particular target area even after reading the putt.

DISCLOSURE OF THE INVENTION

According to the present invention, there is provided a practice putting aid which enables a golfer through use of the aid to mentally focus on a target or location about the golf hole actually being played while attempting to exclude thoughts which might interfere with the golfer's focus and concentration. While the present putting practice aid is used only during putting practice and not during golf play, the golfer, by using this aid, will better his or her ability to line up the putt with clear focus and a positive intention to make the putt. To accomplish this, and in a preferred embodiment of the present invention, there is provided a putting ring preferably in the form of an annulus for placement about the practice golf hole. The annulus has a central opening preferably slightly smaller in diameter than the diameter of the standard golf hole. It also has an outer diameter sufficiently in excess of the diameter of the golf hole such that the annulus may be placed on the grass margin or edge about the hole. The annulus has only a very slight thickness dimension such that when a golf ball is rolled toward the hole, the annulus does not substantially interfere with the path or speed of the golf ball. In this preferred form, the lower face of the annulus preferably has a downward projection, for example, a smaller annulus, or a plurality of spaced projections, for disposition in the golf hole to prevent lateral movement of the annulus when placed over the golf hole.

A principal feature of the present invention resides in providing visually identifiable indicia about the upper face of the annulus to assist the golfer during putting practice to align the putt with the hole and focus on that alignment by reference to the indicia. The indicia thus affords a particular aiming location or target on or near the annulus. For example, the upper face of the annulus can be divided into discrete circumferentially extending segments of different colors. While two or more differently colored segments can be used, it has been found that four segments having discrete colors different from one another and at particular locations about the annulus afford a sufficient number of aiming locations about the annulus. Thus, the forward half of the annulus nearest the golfer during putting practice may comprise three adjoining segments having discrete colors, for example, blue, yellow and red, with first and third blue and red segments, respectively, along opposite front sides of the annulus occupying a circumferentially extending area approximately 45°–60° about the annulus and straddling the remaining yellow segment on the front side. The latter segment preferably occupies a circumferentially extending area approximating 60°–90° about the annulus. A rear segment on the back side of the annulus in relation to the golfer and diametrically opposite the middle segment on the front side likewise has a discrete color, for example, black. This rear segment preferably occupies a circumferentially extending area approximating 50°–60°, and is spaced from the side segments by another or second set of segments. It will be appreciated therefore that the annulus is thus divided into visually identifiable locations by the colored segments at various positions, e.g., the 12 o'clock, 4 o'clock, 6 o'clock and 8 o'clock positions about the annulus, vis-a-vis the golfer standing in front of the annulus at the 6 o'clock position. The demarcation between the segments may comprise radial, angled or curved lines. The visually identifiable locations may also be constituted by any other type of indicia such as numbers, arrows, large dots or squares on the face, or any other indicia which affords predetermined targetable locations about the annulus.

In use, the golfer positions the annulus about the golf hole with the central opening through the annulus in registration and substantially coaxial with the golf hole. The annulus is also oriented by locating the three front segments to face in the general direction from which the golfer wishes to practice putting. The golfer then visualizes the alignment of the putt, accounting for the contour of the putting surface and the break or breaks in that surface. The golfer then recognizes an aiming target or location to which the golf ball should be directed, corresponding it to a visually identifiable location about or near the annulus. For example, if the putt will break slightly from left to right, the golfer may consider an aiming location at the left center or inside left edge of the golf hole. These locations are readily identifiable by the visually identifiable indicia on the upper surface of the annulus. Thus, the golfer may focus on this precise aiming location on the annulus. The aiming location therefore facilitates a focus and concentration on putting the ball to that specific location. Thus, once the golfer has read a putt, the indicia on the annulus affords a specific target at which the golfer may aim the putt. It affords the golfer directional control over the putt, minimizes mental breakdown during putting and further provides increased perception of putting distance affording the golfer improved control over the length of the putt. The annulus also provides a reduced visual cup size, causing the golfer to practice putting in a smaller cup. Consequently, with use of the visual assisted putting annulus or ring of the present invention on: the practice green, the golfer, during regular golf play and without such aid, can better visualize the target location and more clearly focus on that target for improved consistency and accuracy.

In a preferred embodiment according to the present invention, there is provided a practice aid for putting a golf ball into a practice golf hole, comprising an annulus for placement about the golf hole, the annulus having an outer diameter in excess of the diameter of the golf hole, a central opening for registering with and overlying the golf hole, and upper and lower faces, means carried by the annulus and projecting below the lower face for disposition within the golf hole and preventing substantial movement of the annulus in a lateral direction when the annulus overlies the golf hole, the upper face of the annulus being divided into first and second sets of segments spaced one from the other about the annulus, segments of a first set thereof comprising discrete visual indicia identifying target locations about the annulus relative to the golf hole, when the annulus overlies the golf hole, to facilitate alignment of the putt and enable the golfer to putt the golf ball through the central opening of the annulus into the golf hole.

In a further preferred embodiment according to the present invention, there is provided a practice aid for putting a golf ball into a practice golf hole, comprising an uninterrupted continuously extending closed flat strip lying in a plane and having upper and lower faces, an outer edge, and a central circular opening, the strip having an outer lateral dimension at all locations about the strip in excess of the diameter of the golf hole thereby defining at least a portion of said strip for engaging a margin about the golf hole when the strip is disposed about the golf hole with its central opening in registration with the hole, the upper face of the strip having a plurality of discrete visual indicia spaced one from the other about the strip defining target locations, the target locations, when the strip overlies the golf hole, identifying discrete locations about the strip relative to the golf hole to facilitate alignment of the putt with the golf hole and enable the golfer to putt the golf ball through the central opening of the strip into the golf hole.

In a further preferred embodiment according to the present invention, there is provided a practice aid for putting a golf ball into a practice golf hole, comprising a ring lying in a plane and having upper and lower faces, an outer edge, and a central circular opening, the ring having an outer diameter at least substantially equal to the diameter of the golf hole thereby defining at least a portion of the ring for engaging a margin about the golf hole when the ring is located relative to the golf hole with its central opening in registration with the hole, the upper face of the ring having a plurality of discrete visual indicia spaced one from the other about the ring defining target locations, the target locations, when the ring overlies the golf hole, identifying discrete locations about the ring relative to the golf hole to facilitate alignment of the putt with the golf hole and enable the golfer to putt the golf ball through the central opening of the ring into the golf hole.

Accordingly, it is a primary object of the present invention to provide a novel and improved visual golf putting practice aid for improving the focus and :concentration of the golfer when putting and affording during practice a visually identifiable target about the hole and, during play, a visual perception of a target about the hole.

BRIEF DESCRIPTION OF THE DRAWINGS

FIG. 3 is a top plan view of a representative embodiment of a visual assisted putting ring according to the present invention;

FIG. 4 is a fragmentary cross-sectional view similar to FIG. 2 illustrating a further form of the invention hereof;

BEST MODE FOR CARRYING OUT THE INVENTION

Figure 1:
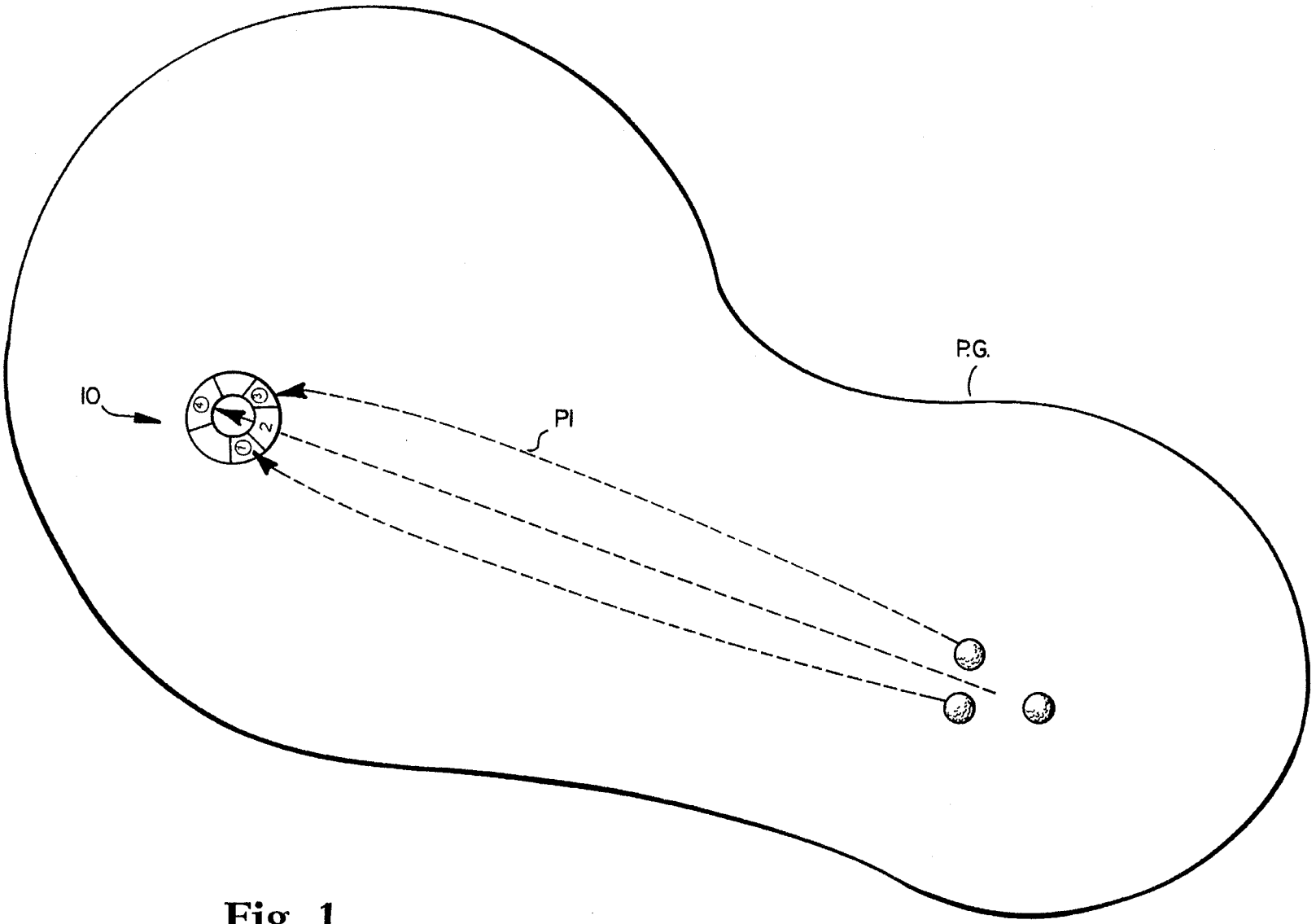
FIG. 1 is a schematic plan view of a practice putting green illustrating use of a visual assisted putting ring according to the present invention.
Figure 2:
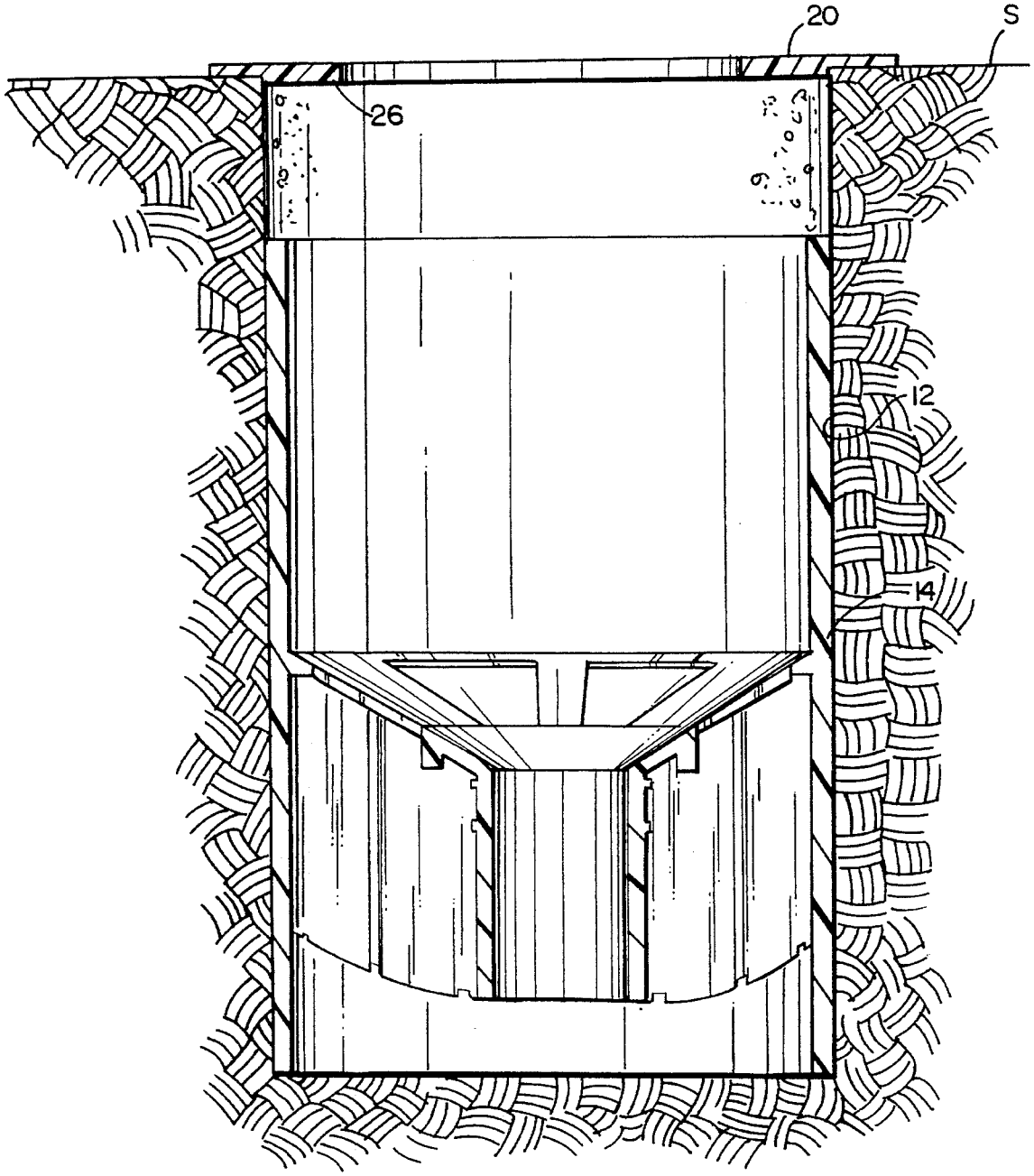
FIG. 2 is an enlarged cross-sectional view of the visual assisted putting ring of the present invention in place overlying a cup or hole of a practice green.

Referring now to the drawings, particularly to FIG. 1, there is illustrated a practice putting green P.G. demonstrating use of the visual assisted putting ring 10 of the present invention. The ring of the present invention is illustrated in FIG. 1 overlying a hole or cup of a practice putting green P.G. As used herein, the terms "hole" or "cup" are used interchangeably. As illustrated in FIG. 2, a typical golf hole 12 is provided with a liner 14. Lining 14 may be formed of a synthetic, e.g., plastic, material and is inserted into a preformed cylindrical hole 12. The bottom of the lining 14 includes a support structure 16 for the bottom of a flagstick, not shown, as well as drainage holes. The hole 12 illustrated in FIG. 2 is a conventional hole with lining 14 as used throughout a typical golf course. A number of holes of this type may also be used on the practice putting green P.G. It will be appreciated that the upper edge of lining 14 extends below the surface S of the green a distance at least one inch, the hole between the upper edge of the lining and the surface S being defined by the soil surrounding the hole.

Referring now to FIGS. 2 and 3, the visually assisted putting ring 10 of the present invention preferably comprises an annulus 20 which lies in a flat and, in use, horizontal plane. Annulus 20 includes an outer edge 22 which has a lateral, e.g., diametrical, dimension across the annulus greater than the diameter of the hole 12. Annulus 20 also includes a central opening 24 having a diameter less than the diameter of the hole 12. Thus, annulus 20 is of a size such that, when the annulus is placed in overlying relation to a hole with its central opening 24 in registration with hole 12, an outer circular lip portion of the annulus rests on the surface S, typically grass, surrounding the upper margin or edge of hole 12. To preclude substantial lateral movement of the annulus 20 relative to the hole during use, the annulus 20 includes a downwardly extending projection or a second annulus 26. The outer circular edge of the second annulus corresponds in diameter to, or is slightly less than, the diameter of hole 12. Annulus 20 may therefore be disposed over hole 12 with the annular projection 26 disposed in the hole such that the annulus 20 is not substantially displaced laterally or otherwise relative to the hole 12 upon movement of the ball over its upper face during putting practice.

Figure 5:
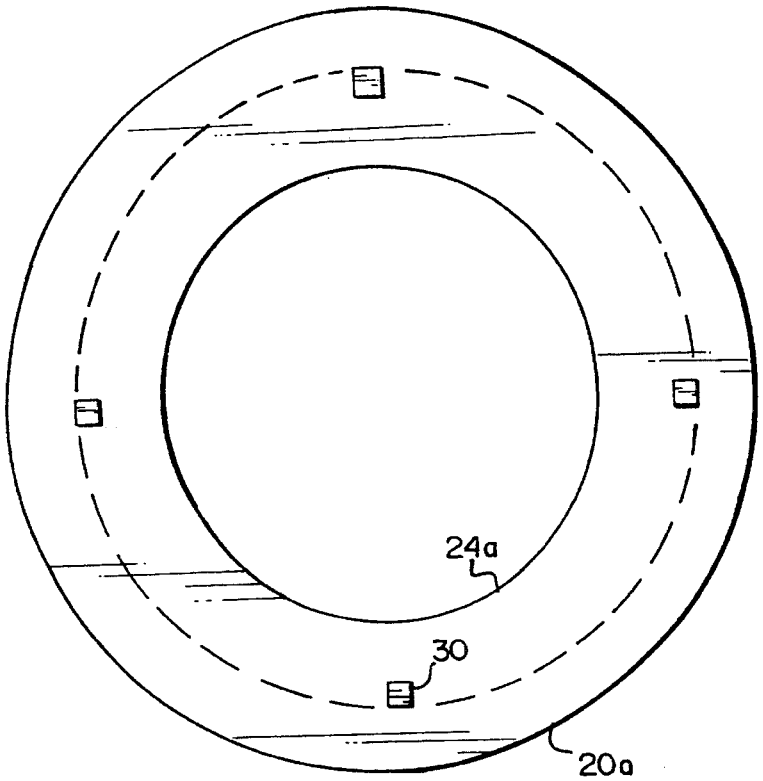
FIG. 5 is a bottom plan view of the ring of FIG. 4.
Figure 6:
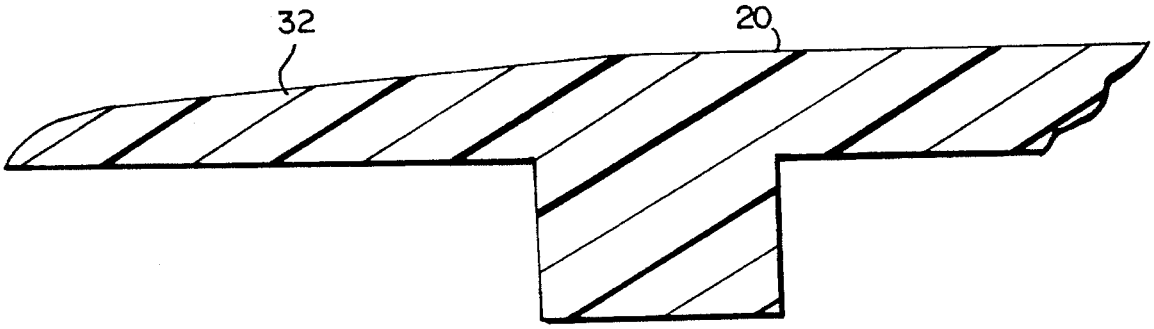
FIG. 6 is an enlarged fragmentary cross-sectional view illustrating an outer edge of the visually assisted putting ring of the present invention.

With reference to FIGS. 4 and 5, there is illustrated a further form of visual assisted putting ring of the present invention wherein annulus **20*a* has a plurality of discrete or individual projections 30 extending downwardly from its lower face. The projections 30 are located about the lower face of the annulus along a perimeter or circumference which corresponds in diameter to, or is slightly less than, the diameter of the hole 12. Thus, when placing annulus 20*a* over hole 12, the downwardly extending projections 30 preclude substantial lateral or other displacement of the annulus relative to the hole. Also, as illustrated in FIG. 6, the outer edge of either annulus 20 or 20*a* may be feathered or tapered outwardly and downwardly as indicated at 32 to facilitate passing the ball over the annulus as it rolls toward the hole 12**.

While a preferred form of the putting aid of the present invention comprises a ring or annulus overlying the golf hole, the ring or annulus may be sized, i.e., have a diameter, corresponding to the diameter of the cup. It has been found that an aid of this size can be positioned within the cup with its upper surface lying flush with the grass about the hole. The corresponding diameters of the annulus and the cup enable the annulus to be supported by engagement of the outer edge of the annulus and the edge of the hole and without further support. Even when the annulus lies flush with the grass surface, the visual indicia on the upper surface of the aid facilitates alignment of the putt as discussed herein.

The visually assisted putting ring of the present invention is preferably about 4 13/16 inch in outer diameter, with a 2¾–3-inch central opening. It will be appreciated that the outer diameter can be extended. Preferably, however, it is no greater than 6 inches in order to maintain a capability of carrying the ring in the individual golfer's pocket. The thickness of annulus 20 (without projection 26) is preferably about 1/32-inch. It will also be appreciated that the thickness of the annulus can be varied from that preferred dimension. However, the ring is intended to constitute a semi-rigid or rigid structure in contrast to a flexible structure and, accordingly, the thickness of the annulus (together with the downward projection 26) must be sufficient to provide that rigidity while the annulus must simultaneously be sufficiently thin to enable the golf ball to roll over the annulus without displacing the annulus or affecting the path of travel of the golf ball. With respect to the downwardly projecting annulus 26, the entire thickness of the ring 20 including annulus 20 and annulus 26 is about 3/16-inch and should not exceed ¼ inch. The width of the projecting annulus 26 is about ⅝-inch. It will be appreciated that, by rule, i.e., The Rules of Golf as approved by The United States Golf Association and The Royal and Ancient Golf Club of St. Andrews, Scotland, a golf hole is 4¼ inches in diameter. Consequently, a preferred diameter of the projecting annulus 26 is between 4 inches and 4¼ inches. The central opening 24 preferably has a diameter of about 2¾ to 3 inches. With respect to materials, the visual assisted putting ring 10 of the present invention may be formed of a wide variety of materials, provided the ring is semi-rigid or rigid in structure. For example, the ring is preferably formed of a plastic material, although it will be appreciated that other materials, such as metal, rubber, or wood can be utilized. Also, while the terms "annulus" and "ring" have been used to describe the putting aid hereof, other shapes may be used, provided only that each such shape be continuous and closed about a central opening and have the indicia on its upper face, as will now be described.

In accordance with a principal aspect of the present invention, the visual assisted putting ring 10 is provided with visually identifiable indicia along its upper face to provide the golfer with targets or aiming locations depending upon the alignment of the putt which is, in turn, dependent upon the contour of the practice putting green. That is, the visually identifiable indicia enable the golfer to direct or aim a putt to a specified location considering the contour of the putting surface. For example, such indicia may be include segments on the upper face of the ring provided in different discrete colors at specific locations about the ring. With specific reference to the preferred embodiment hereof illustrated in FIG. 3, it will be seen that there are four colored segments formed on the upper surface of annulus 20. Segments 40, 42 and 44 lie adjacent and in sequence relative to one another along the lower half of annulus 20 as illustrated in FIG. 3. Segments 40 and 44 each may comprise a segment having a circumferential extent of 45°–60° from a diameter of the ring, while the segment 42 between segments 40 and 44 may comprise a circumferential extent of approximately 60°–90°. While a wide variety of colors may be used, very distinguishing contrasting colors are preferred. For example, segments 40, 42 and 44 may be colored bright blue, yellow and red, respectively. A fourth segment 46 is disposed on the upper half or back side of the ring and preferably has a slightly larger circumferential extent than the segments 40 and 44, for example, on the order of 50°–60°. These segments 40, 42, 44 and 46 leave additional portions of the ring 20 between segment 46 and segments 40 and 44. These additional portions thus form a second set of segments 48 and 50 along the annulus at those discrete locations. Segments 48 and 50 give definition to the segments 40, 42, 44 and 46, for example, by being a different color, i.e., a base color such as white, and may contain advertising material, such as the name of a sponsor or an advertiser for a golfing event. The term "logo" as used in the drawing figures connotes the spaces or second set of segments of the ring which may be used for advertising material.

Other visually identifiable indicia may be used in lieu of colored segments. For example, in FIG. 3, the numeral designations 1, 2, 3 and 4 are disposed at the locations corresponding generally to the segments 40, 42, 44 and 46. Thus, numerals alone at these specific locations and without the color segments may be used. Other indicia may also be used, for example, arrows, symbols or even logos of sponsors or advertisers. These other indicia may be used alone or in combination with the colored segments as illustrated in FIG. 3, where the colored segments and numerals are illustrated in combination.

As illustrated, the visually identifiable indicia on the ring are preferably located at the 8 o'clock, 6 o'clock, 4 o'clock and 12 o'clock positions about the ring relative to a golfer looking on from the 6 o'clock position. This corresponds to segments 40, 42, 44 and 46 or the numbers 1, 2, 3 and 4, respectively, as illustrated in FIG. 3. While the ring can be broken up into different segments or different aiming locations than as described, it will be appreciated that the concept remains the same, i.e., affording an aiming location for the golfer on or near the annulus. For example, the indicia may comprise two segments, one segment extending approximately 240° symmetrically about the back side of the ring, and a second segment approximately 120° along the front side. The discrimination among these two segments would afford a number of aiming points. It will be appreciated that two or more visual indicia may be provided about the ring on its upper face consistent with the present invention and at locations providing the golfer with nine aiming points as noted above.

To use the visually assisted putting ring hereof, the golfer locates the ring 22 over practice hole 12, the central opening 24 lying in registration with hole 12. It will be appreciated that the underside or lip of annulus 20 outwardly of the downward projection rests on the grass margin about the opening and that the annulus is not otherwise supported. Generally, the annulus is oriented with the lower half containing the segments 40, 42 and 44 facing the golfer and the direction from which the golfer will practice putt. When the golfer has aligned the putt, taking into consideration the contour of the putting surface between the golf ball and the hole, the golfer will recognize, considering the break of the ball, a specific aiming or target location corresponding to an indicium on the putting ring 22. For example, if the putt will break from right to left as illustrated by putt P1 in FIG. 1, the golfer will recognize that a suitable target location may be the inside right edge. Consequently, by focussing on segment 44 (or number 3) and even more particularly focussing along the inside edge of segment 44 towards its juncture with segment 50, the golfer is afforded an aiming location, i.e., a specific visually distinct target. By mentally focussing on that target, the golfer's mental process remains concentrated to the extent that the golfer's entire focus is essentially solely on rolling the ball to that target. Thus, the ring affords the golfer a specific target to aim for once the putt has been read. A target for a straight uphill putt P2 in FIG. 1 would therefore comprise the numeral 4 or segment 46 at the back of the ring. A different target is provided for a left-to-right breaking putt P3, i.e., indicia 1 on segment 40. The provision of a specific aiming point also assists the golfer in providing a "feel" for the strength of the putt enabling a sharper perception of distance and necessary speed of the stroke. The ring also reduces the cup size, visually causing the golfer to practice putting at a smaller hole than the conventional golf hole. The inner diameter of the ring may be varied such that an annulus may be provided with increased or decreased inner diameter in accordance with the skill level of the golfer. Significantly also is the fact that the annulus 20 is of a size and has a flatness with minimum thickness to enable it to fit into the golfer's pocket or golf bag when practice putting is over and the golf game is to be played. While the size of the annulus may be increased and have an inner diameter less than, equal to or greater than the diameter of the hole, it is preferable to provide the aid hereof with the dimensions previously set forth as those have been found extremely effective for the purposes stated herein.

It will be appreciated that the visual assisted putting ring hereof is not intended for use during actual play of the game of golf. It is solely a practice aid. However, it has been demonstrated that use of the visual assisted putting ring during practice enables a golfer during actual play to associate the aiming locations or targets of the practice ring with the respective parts of the hole actually being played. That is, the golfer will mentally visualize the specific indicia, whether it be a color, number, arrow, etc., selected in accordance with the alignment of the putt, with a specific part of the hole actually to be played, facilitating the golfer's ability to align the putt and give his entire focus and attention to making that putt.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A practice aid for putting a golf ball into a practice golf hole, comprising:

an annulus for placement about the golf hole, said annulus having an outer diameter in excess of the diameter of the golf hole, a central opening for registering with and overlying the golf hole, and upper and lower faces;

means carried by said annulus and projecting below said lower face for disposition within the golf hole and preventing substantial movement of said annulus in a lateral direction when said annulus overlies the golf hole;

the upper face of said annulus being divided into first and second sets of segments spaced one from the other about the annulus, segments of a first set thereof comprising discrete visual indicia identifying target locations about the annulus relative to the golf hole, when the annulus overlies the golf hole, to facilitate alignment of the putt and enable the golfer to putt the golf ball through the central opening of the annulus into the golf hole.

2. A practice aid according to claim 1 wherein said projecting means includes a plurality of discrete locating elements for projection within the golf hole to maintain said central opening in registration with the golf hole.

3. A practice aid according to claim 1 wherein the projecting means includes a continuous generally annular projection having an outer diameter substantially corresponding to the diameter of the hole and inset from an outer margin of said annulus.

4. A practice aid according to claim 1 wherein the diameter of the central opening is less than the diameter of the golf hole.

5. A practice aid according to claim 1 wherein said discrete visual indicia about said annulus are different in appearance relative to one another.

6. A practice aid according to claim 1 wherein said discrete visual indicia comprises different colors applied to respective segments of said first set to differentiate each segment of said first set from each other segment of said first set.

7. A practice aid according to claim 1 wherein said discrete visual indicia comprises :numerals on each segment of said first set distinguishing the segments of said first set from one another.

8. A practice aid according to claim 1 wherein the segments of said second set thereof each have discrete visual indicia, the discrete visual indicia of the first set of segments being different from one another and from the visual indicia of the segments of said second set thereof to visually distinguish the segments of the first set from one another and the segments of said second set.

9. A practice aid according to claim 1 wherein the first set of segments include first, second, third and fourth segments, said first, second and third segments adjoining one another in series along an arc of the annulus of about 180°, said fourth segment being separated from said first and third segments by segments of said second set of segments and lying diametrically opposite said second segment.

10. A practice aid according to claim 1 wherein said segments of said first set of segments have discrete visual indicia different from one another to visually distinguish the segments of the first set from one another, said segments of said first set of segments being located at 12 o'clock, 4 o'clock, 6 o'clock and 8 o'clock positions about said annulus as viewed by a golfer aligning a putt with the golf hole with the 6 o'clock position of the annulus nearest the golfer.

11. A practice aid according to claim 1 wherein the outside diameter of said annulus is no greater than six inches and the thickness of the aid does not exceed ¼ inch.

12. A practice aid for putting a golf ball into a practice golf hole, comprising:

an uninterrupted continuously extending closed flat strip lying in a plane and having upper and lower faces, an outer edge;, and a central circular opening, said strip having an outer lateral dimension at all locations about said strip in excess of the diameter of the golf hole thereby defining at least a portion of said strip for engaging a margin about the golf hole when the strip is disposed about the golf hole with its central opening in registration with the hole;

the upper face of said strip having a plurality of discrete visual indicia spaced one from the other about the strip defining target locations, said target locations, when said strip overlies the golf hole, identifying discrete locations about the strip relative to the golf hole to facilitate alignment of the putt with the golf hole and enable the golfer to putt the golf ball through the central opening of the strip into the golf hole.

13. A practice aid according to claim 12 wherein said discrete visual indicia defining said target locations lie in the plane of said strip.

14. A practice aid according to claim 13 including means carried by said strip and projecting below said lower face thereof for disposition within the golf hole for preventing substantial movement of said strip in a lateral direction when overlying the golf hole, said strip portion and said preventing means defining a lip for engaging the margin about the hole.

15. A practice aid according to claim 12 wherein the diameter of the central opening is less than the diameter of the golf hole.

16. A practice aid according to claim 12 wherein said discrete visual indicia comprise discrete colors applied to said upper planar face of said strip for differentiating each target location from each other target location about said strip.

17. A practice aid according to claim 12 wherein said discrete visual indicia comprise numerals applied to said upper planar face to differentiate each target location from each other target location about said strip.

18. A practice aid according to claim 12 wherein the visual indicia defining target locations include first, second, third and fourth locations about said strip, said first, second and third locations lying sequentially relative to one another along a front half of said strip as viewed by a golfer from the front of said strip, said fourth location being spaced from said first, second and third locations and lying along a rear half of said strip diametrically opposite said second location across said central opening as viewed by the golfer from the front of said strip.

19. A practice aid according to claim 12 wherein said visual indicia defining target locations are located at 12 o'clock, 4 o'clock, 6 o'clock and 8 o'clock positions about said strip as viewed by a golfer aligning a putt with the golf hole with the 6 o'clock position nearest the golfer.

20. A practice aid for putting a golf ball into a practice golf hole, comprising:

a ring lying in a plane and having upper and lower faces, an outer edge, and a central circular opening, said ring having an outer diameter at least substantially equal to the diameter of the golf hole thereby defining at least a portion of said ring for engaging a margin about the golf hole when the ring is located relative to the golf hole with its central opening in registration with the hole;

the upper face of said ring having a plurality of discrete visual indicia spaced one from the other about said ring defining target locations, said target locations, when said ring overlies the golf hole, identifying discrete locations about the ring relative to the golf hole to facilitate alignment of the putt with the golf hole and enable the golfer to putt the golf ball through the central opening of the ring into the golf hole.

* * * * *